US005289670A

United States Patent [19]

Morgan et al.

[11] Patent Number: 5,289,670

[45] Date of Patent: Mar. 1, 1994

[54] METHOD AND APPARATUS FOR HANDLING TOBACCO AND OTHER BULK GOODS

[75] Inventors: Estace L. Morgan, Sanford; Alvin R. Tilley, Fuquay-Varina, both of N.C.

[73] Assignee: Universal Protector Corporation, Fuquay-Varina, N.C.

[21] Appl. No.: 939,598

[22] Filed: Sep. 2, 1992

[51] Int. Cl.[5] ..... B65B 11/48; B65D 65/00; B65D 30/00

[52] U.S. Cl. ..... 53/461; 53/390; 383/4; 383/77; 229/87.01; 229/87.04

[58] Field of Search ..... 383/4, 77; 53/390, 461; 229/87.01, 87.04

[56] References Cited

U.S. PATENT DOCUMENTS

| | | | |
|---|---|---|---|
| 1,236,285 | 8/1917 | Gallie | 383/77 |
| 2,749,957 | 6/1956 | Smith | 383/4 |
| 2,766,797 | 10/1956 | Cowen | 383/4 |
| 3,217,971 | 11/1965 | Shvetz | 383/77 |
| 3,664,575 | 5/1972 | Lake | 383/77 |
| 3,679,126 | 7/1972 | Lake | 383/77 |

*Primary Examiner*—Stephen P. Garbe
*Attorney, Agent, or Firm*—Rhodes, Coats & Bennett

[57] ABSTRACT

The present invention entails a method and apparatus for handling tobacco wherein a sheet is provided with sleeves formed in opposite corners thereof with the other two corners of the sheet being left with free corner ends. Once tobacco or other bulk material is placed on the sheet then the free corner ends are threaded through respective sleeves and then tied into a suitable knot thereby forming a sheet-like container bound around the tobacco or other material. Thereafter, the package or containerized material can be handled and even lifted by grasping the free end knot.

9 Claims, 3 Drawing Sheets

METHOD AND APPARATUS FOR HANDLING TOBACCO AND OTHER BULK GOODS

FIELD OF THE INVENTION

The present invention relates to containerizing and handling dried tobacco and more particularly to a sheet-type container and handling medium for holding and supporting dried tobacco material as the same is transferred from the farm to market and then to processing.

BACKGROUND OF THE INVENTION

Today, cured or dried tobacco is containerized in a sheet and transported from the farm to the warehouse where the tobacco is sold and thereafter the sheets of bulk tobacco are taken off the warehouse floor by the manufacturer or processor and taken to a processing plant for further drying and processing. Typically, the bulk tobacco is placed in a burlap type sheet and the respective corners are pulled up over the formed pile of tobacco and opposite corners of the sheet are tied into a square knot or other type knot. In the end, the sheet is secured about the tobacco by a pair of knots with each knot being formed by opposite corners of the sheet. During the course of transferring and handling the tobacco the corner knots will be lifted by a hoist-type device and during the course of the lifting the respective knots will be pulled and in fact the weight of the tobacco will be supported by the respective knots during the course of lifting. This causes the knots to be pulled and tightened very tight. This gives rise to a basic problem at the warehouse and at the processing plant. The knots have to be untied. Often, the knots have been pulled to such an extent that it is virtually impossible to untie the knots.

Workers with pliers and other instruments pull and work at attempting to untie these very hard knots but often it is impossible to do. In many instances the individual attempting to untie the knot gives up and the knot is cut from the sheet with a knife or other type of cutting instrument. This, of course, has the effect of destroying the sheet and in the end this costs the tobacco farmer, the warehouseman, and the processor or manufacturer.

It is common in certain geographical areas for the tobacco farmers, warehouseman and processors to form a Sheet Board of Trade that controls the issuance of these tobacco sheets. Typically, the farmer, the warehouseman, and the processor contribute proportionally to the Sheet Board of Trade and these contributions are used by the Sheet Board to buy and maintain sheets and to administer the sheet program. As pointed out above, one of the major problems facing Sheet Boards today is that the knots tied in the sheet becomes so tight that workers are forced to cut the knots and in the process sheets are destroyed. This has become a real problem over the years and continues to cost tobacco farmers, warehouseman and manufacturers or processors substantial.

Therefore, there has and continues to be a need to develop an improved method of handling tobacco that will save sheets and prevent workers from having to cut knots in the sheet which ends up destroying the sheet and costing farmers, warehouseman and processors.

SUMMARY AND OBJECTS OF THE INVENTION

The present invention entails a new method and apparatus for handling bulk tobacco and other such goods. The present method eliminates the problem of excessively tight knots that results in the knot portion of the sheet being cut from the sheet and effectively destroying the sheet. In particular, the sheet of the present invention is formed with a pair of sleeves in opposite corners of the sheet. The remaining free ends of the sheet are then threaded through the formed sleeve causing the sheet to be pulled up and around the pile of tobacco and finally the two free ends of the sheet are tied into a non-binding knot. Once the sheet has been accordingly tied around a pile of tobacco, the containerized tobacco is transported to market where it is set in place on the tobacco warehouse floor and opened for inspection by passing buyers. Once the sale is completed the same sheets are then appropriately tied around the tobacco and transported to a processing plant where the sheets are again lifted by the knotted end, opened, and the tobacco therein is subjected to further drying and processing. In the course of being handled at the warehouse and at the processing plant, it is common practice for the piles of tobacco to be lifted by a hoist. In doing this, the hoist is attached at or about the formed knot and the weight of the tobacco is carried by the knot and the associated sleeve to which the corner portions of the sheet pass through. Therefore, it is appreciated that the sheet apparatus of the present invention and the method of containerizing the bulk tobacco effectively eliminates one knot and by particularly forming a non-binding knot with the two free corners of the sheet it is appreciated that the problems discussed with the prior art sheets and method of containerizing bulk tobacco is eliminated.

It is therefore an object of the present invention to provide a new sheet method of containerizing tobacco that eliminates the problems of excessive tight knots formed in the sheet containerizing the tobacco.

A further object of the present invention entails a method of tying a flexible sheet around a pile of tobacco in such a fashion that only one single knot is required, effectively doing away with the conventional two-knot process.

Another object of the present invention revolves around providing a sheet having a pair of sleeves formed in opposed corners thereof.

Still a further object of the present invention revolves around a method of containerizing tobacco wherein free ends of the sheet referred to above are threaded through the formed sleeve and then tied into a non-binding knot around a pile of bulk tobacco.

Another object of the present invention revolves around a method of handling tobacco wherein a sheet of tobacco can be pulled up and lifted by a hoist in such a fashion so as to not cause the knot portion of the sheet to be pulled to a position where the knot is excessively tight.

In the end it is an object of the present invention to provide a sheet structure and a method of tying a sheet around a pile of bulk tobacco that would enable individuals to easily and conveniently tie and untie the sheet without having to cut knots from the sheet and destroy the sheet itself.

Other objects and advantages of the present invention will become apparent and obvious from a study of the following description and the accompanying drawings which are merely illustrative of such invention.

DETAILED DESCRIPTION OF THE INVENTION

Figure 1:
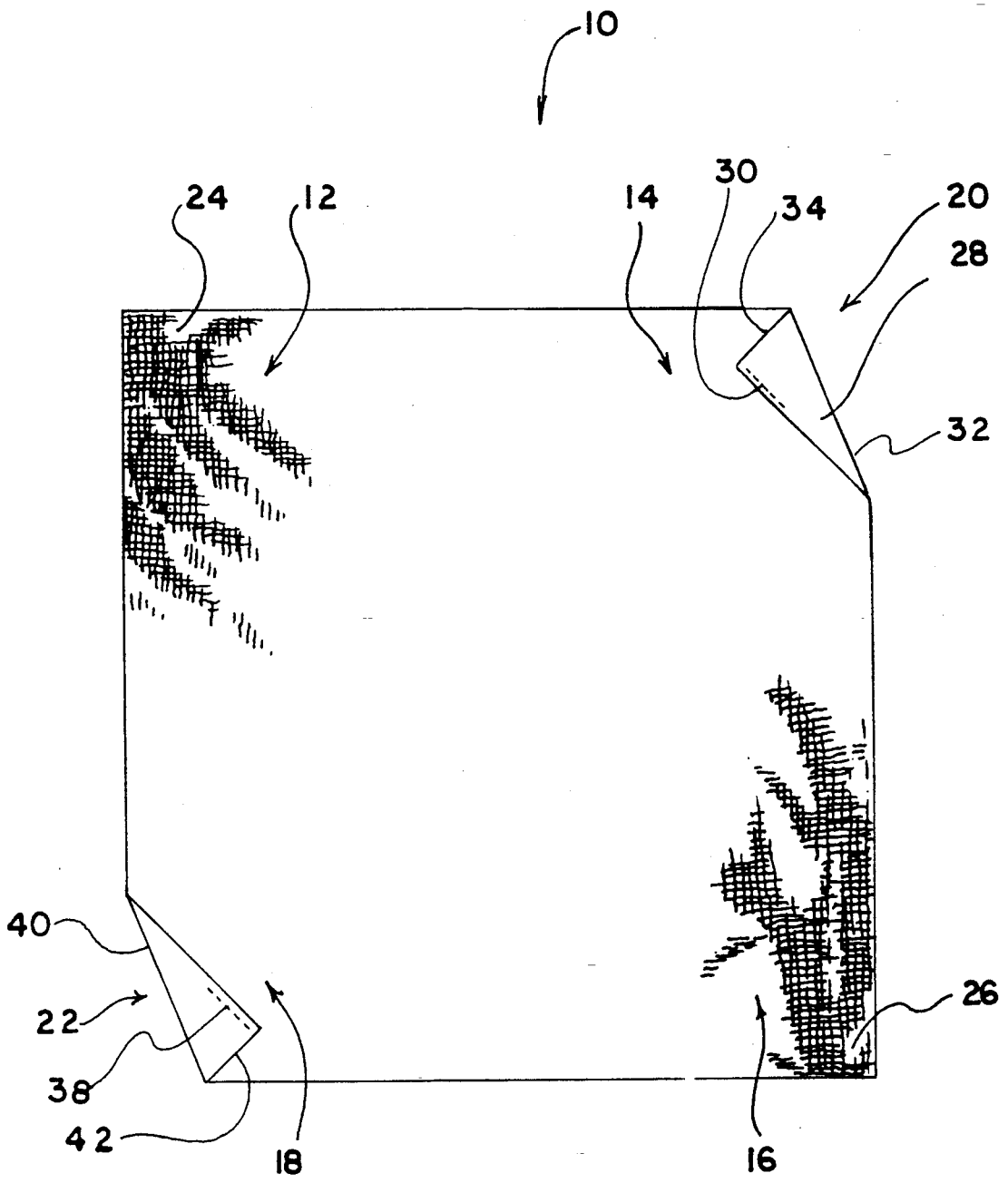
FIG. 1 is a top plan view of the tobacco sheet of the present invention showing the stitched sleeves.
Figure 2:
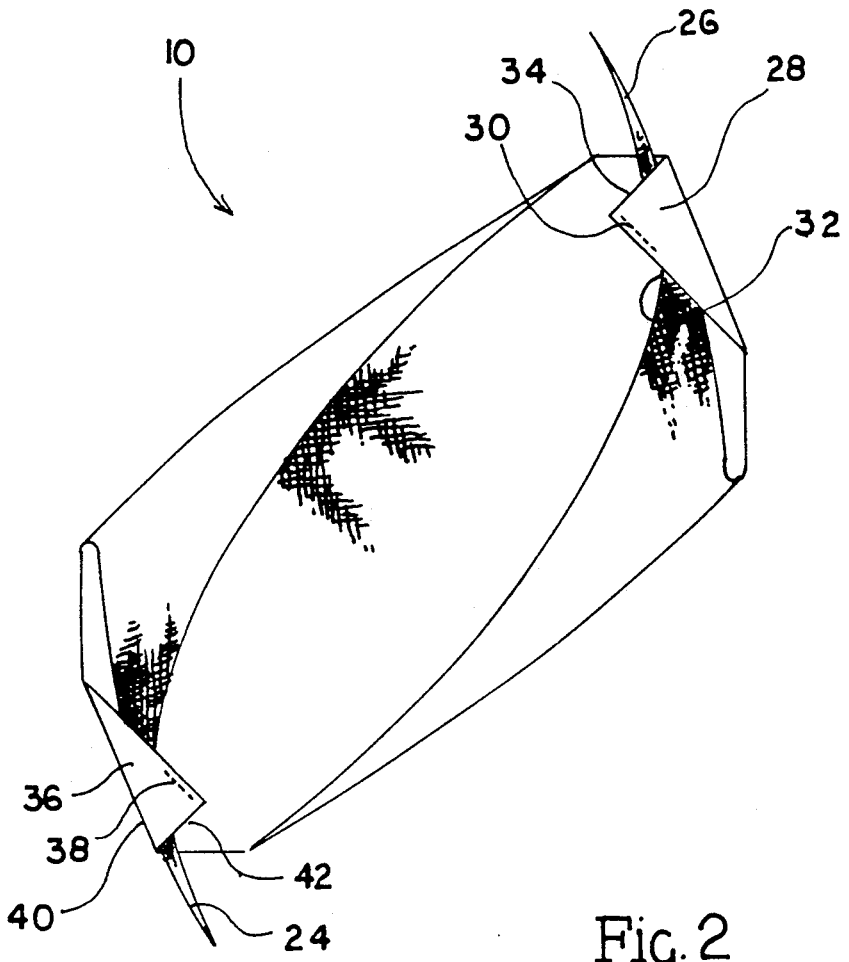
FIG. 2 is a top plan view of the tobacco sheet showing the free ends of the sheet being threaded through the respective sleeves.
Figure 3:
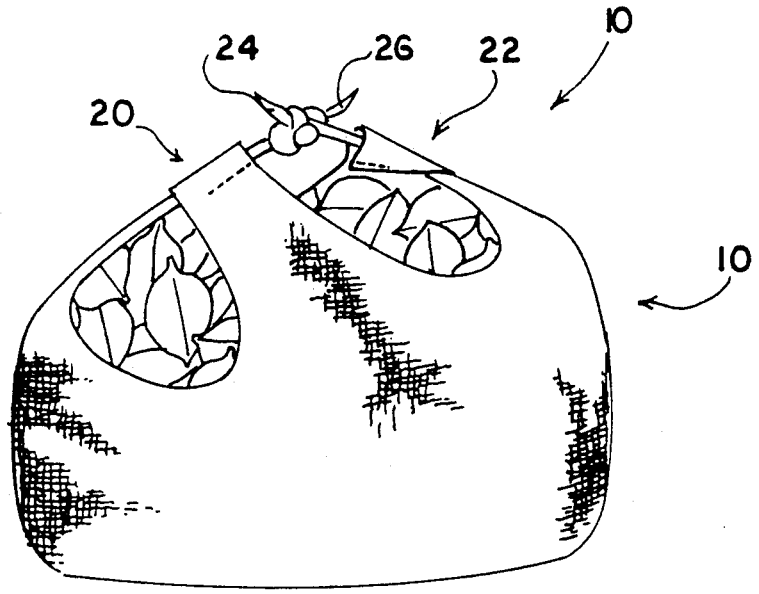
FIG. 3 is a side elevational view of the tobacco sheet of the present invention shown in a tied configuration around a pile of bulk tobacco.

With further reference to the drawings, the tobacco containerization sheet of the present invention is shown therein and indicated generally by the numeral 10. Sheet 10 is a pliable and flexible sheet-like structure and can be constructed of various sheet material. But in a preferred embodiment of the present invention it is contemplated that the sheet structure 10 would be made up of a conventional burlap type material.

Viewing the sheet 10 in more detail it is seen that the same includes four corner portions indicated generally by the numeral 12, 14, 16, and 18 While the basic dimensions of the sheet 10 can vary, it is contemplated that in most applications it will be preferred that the sheet be approximately eight feet square.

Formed in opposed corners of the sheet 10 are a pair of sleeves indicated generally by the numerals 20 and 22. The two remaining corners of the sheet 10 remain free and are not formed into sleeves. These two free corners are referred to as free corners and by the numerals 24 and 26.

Viewing sleeve 20 it is seen that the same includes an upper lap panel 28 that is folded back over a lower portion of the sheet and a diagonal seam 30 attaches the lap panel 28 to the sheet so as to form a through opening through the entire sleeve 20. As seen in the drawings, sleeve 20 is particularly designed so as to have a large open side 32 and a small open side 34. Although these sides can in certain applications be equal it is appreciated that in other applications there are advantages to making the sleeve openings unequal in size. In the present embodiment, for example, it is contemplated that the large open side 32 would extend approximately fourteen inches when laid flat while the small open side 34 would extend approximately eight inches when laid flat.

In like fashion, sleeve 22 is constructed and includes a lap panel 36, a diagonal seam 38, a large open side 40, and a small open side 42. As with sleeve 22 and the preferred embodiment illustrated herein, the large open side extends a length of approximately fourteen inches (when laid flat) while the small open side extends the length of approximately eight inches (when laid flat). As noted above the size of these openings can vary. For clarity when we note that the large openings are fourteen inches when laid flat (as viewed in FIG. 1) we are simply noting that the diameter of the opening is approximately fourteen inches.

Now turning to the method of utilizing the sheet 10 of the present invention to containerize and hold bulk tobacco for handling and shipping. First, the sheet 10 is laid out in a flat configuration as illustrated in FIG. 1. Next, dry bulk tobacco is piled within the center of the sheet. Now the tobacco is ready to be wrapped and containerized within the sheet 10. In order to do this, free end 26 is threaded into the large opening 32 and pulled through the sleeve 20 to where the same exits small open side 34. The other free end 24 is inserted into the large open side 40 and pulled through sleeve 22 and then out the sleeve via small open side 42. It is now appreciated that the free ends 24 and 26 have been appropriately threaded through the respective sleeves 20 and 22. At this point the surrounding edge structure of the sheet including the free corner ends 24 and 26 and the sleeves 20 and 22 are pulled up over the pile of tobacco and the free corner ends 24 and 26 are pulled tight causing the sheet to wrap tightly around the tobacco and to form a surrounding pouch for holding the tobacco. Thereafter, the two free corner ends 24 and 26 are tied into a non-binding knot so as to secure the entire sheet structure 10 around the pile of bulk tobacco.

Figure 4A:
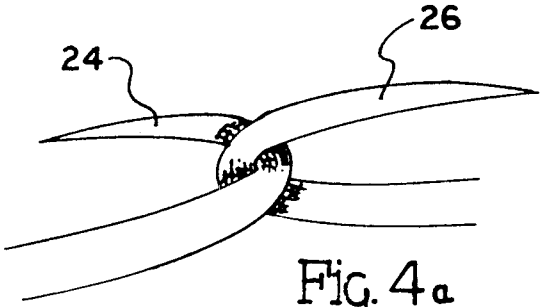
FIG. 4*a*–4*e* are a sequence of views illustrating the tying of a non-binding knot via the two free ends of the tobacco sheet.
Figure 4B:
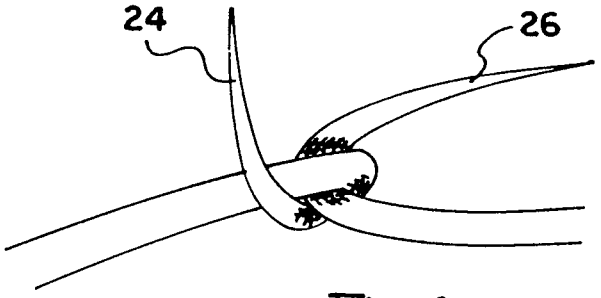
Figure 4C:
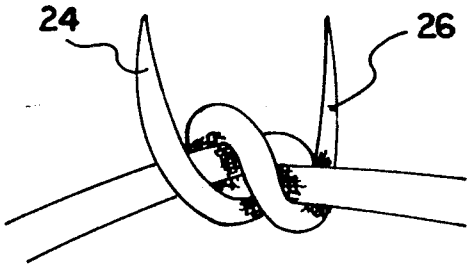
Figure 4D:
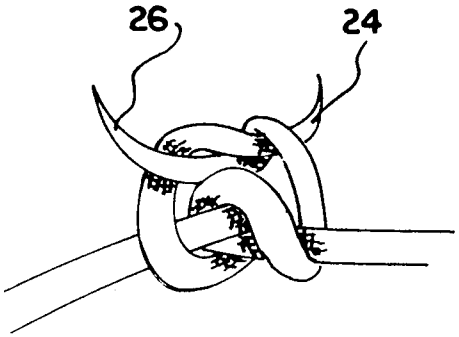
Figure 4E:
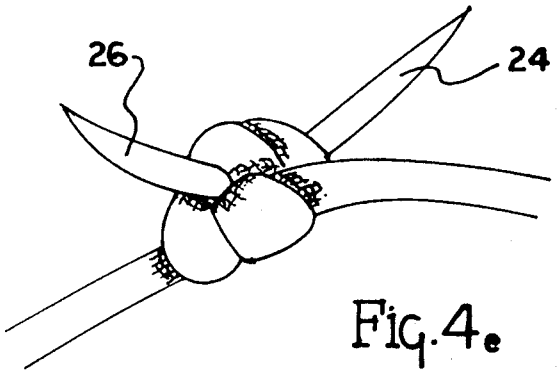

In the case of the preferred embodiment of the present invention, the two free corner ends 24 and 26 are tied in such a fashion that a secured but non-binding knot is made and can be easily untied without having to cut the same from the tobacco sheet 10. To achieve such a secure and non-binding knot the following knot structure is suggested and disclosed herein. First, the free corner end 24 and the free corner end 26 are pulled past each other and folded in reverse directions (FIG. 4*a*). This forms what is referred to as the base of the knot. Next, the free corner end 24 is wrapped behind and under the base of the knot and is brought back to the top of the base of the knot. Next, free corner end 26 is wrapped to the front and under the base knot and brought back to the top of the same (FIG. 4*c*). Then the two free ends are tied, not tight, but snugly (FIGS. 4*d* and 4*e*). It is important to note that during the first three steps of the knot process outlined above, before the free ends are tied, that the base knot be held snugly and firmly.

To untie the knot just described, one can simply pull rearwardly on the straightest ear of the knot. This, in most instances, will free the entire knot structure.

In a tied state, the entire sheet structure 10 surrounds the pile of bulk tobacco and holds the tobacco neatly and securely within the bounds of the sheet. While a small top portion of the sheet 10 may remain open, the pile of tobacco is substantially encompassed by the sheet structure 10.

The sheet 10 in a tied and supporting configuration can be secured to a hoisting device for lifting the tobacco material. A hook or other attaching device can simply be placed under the tied free corners ends 24 and 26 and the entire pile of bulk tobacco held in the sheet can be lifted and handled in any conventional manner. It obviously follows that due to the sleeve construction of one set of opposed corners of the sheet that there can be no problem with a knot structure being so tight that it cannot be conveniently untied. In the end, there is not as much weight carried by the single knot structure as would be expected since a substantial portion of the weight of the pile of tobacco is carried by the sleeves 20 and 22.

Therefore, it is appreciated that the sheet structure 10 of the present invention and the method disclosed herein is suitable for containerizing and handling bulk products and especially is useful in handling tobacco during the course of transferring the bulk tobacco from the farm, to market, and on to a further processing plant. The one major advantage to the sheet structure 10 of the present invention and the method of containerizing the bulk tobacco is that the sheet 10 is designed such that the bulk tobacco can be held and containerized in such a fashion that will eventually save the end portions of the sheet from being cut during the total handling process from the farm to the processor. Moreover, there are substantial labor savings for the farmer, warehouser, and manufacturer or processor. That, in the end, translates in dollar savings to the farmer, to the warehouseman and to the manufacturer or processor.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of handling and containerizing tobacco for shipment from the farm to market and then to processing, comprising the steps of:

a) filling the central portion of a flexible sheet with tobacco;

b) threading one corner of the sheet through a sleeve formed in a first adjacent sleeve corner;

c) threading a second corner of the sheet through a sleeve formed in a second adjacent sleeve corner;

d) pulling the first and second corners through the respective sleeves and pulling the sheet up around the tobacco so as to generally wrap the sheet around the tobacco so as to contain the tobacco within a sleeve sheet; and e) securing the first and second corners together so as to containerize and secure the tobacco within the sleeve sheet.

2. The method of claim 1 including the step of lifting the filled sheet of tobacco by grasping the secured corners.

3. The method of claim 1 wherein the step of securing the first and second corners together include wrapping the first and second corners past each other and folding the same in reverse directions to form a base knot, wrapping the first corner behind and under the base knot and returning the same to the top, wrapping the second corner to the front and under the base knot and returning the same to the top, and tying the two corners together.

4. A sheet structure for encompassing, holding and supporting bulk material such as bulk tobacco, comprising in a tie configuration: a sheet structure having four corners portions with a pair of sleeves formed in opposite corner portions and a pair of free ends existing in the remaining two corner portions; one free corner end being extended completely through adjacent sleeve and pulled therethrough leaving one free corner end clear of the sleeve but confined by the sleeve; the other free end being extended completely through the other adjacent sleeve and pulled therethrough leaving the other free end clear of the adjacent other sleeve but confined by the adjacent other sleeve; the two free ends being secured together so as to hold the entire sheet in a wrapped configuration around the bulk material and wherein the secured free ends form a connector for a hoist and wherein the sheet and bulk material are held with the free corner ends of the sheet and the pair of sleeves wherein the secured free corner ends are connected to a hoist and lifted.

5. The sheet structure of claim 4 wherein the sleeve includes a relatively large opening formed on one side of the sleeve while there is provided a relatively small opening on the opposite side of the sleeve.

6. The sleeve structure of claim 5 wherein the relatively large opening of the sleeve forms the entry end to the sleeve for the adjacent free end while the relatively small opening to the sleeve forms the exiting end of the sleeve for the adjacent free corner end, whereby the free corner ends of the sheet are first threaded into the adjacent large openings of the sleeve while the respective free corner ends exit the relatively small opening of the respective sleeve.

7. The sleeve structure of claim 6 wherein the free corner ends are threaded through the closest relatively large opening in the sleeve.

8. A method of handling and containerizing bulk material, comprising the steps of:

a) filling the central portion of a flexible sheet with bulk material;

b) threading one corner of the sheet through a sleeve formed in a first adjacent sleeve corner;

c) threading a second corner of the sheet through a sleeve formed in a second adjacent sleeve corner;

d) pulling the first and second corners through the respective sleeves and pulling the sheet up around the bulk material so as to generally wrap the sheet around the bulk material so as to contain the bulk material within a sleeve sheet; and e) securing the first and second corners together so as to containerize and secure the bulk material within the sleeve sheet.

9. The method of claim 8 wherein the step of securing the first and second corners together include wrapping the first and second corners past each other and folding the same in reverse directions to form a base knot, wrapping the first corner behind and under the base knot and returning the same to the top, wrapping the second corner to the front and under the base knot and returning the same to the top, and tying the two corners together.

* * * * *